US005137307A

United States Patent [19]

Kinsey

[11] Patent Number: 5,137,307

[45] Date of Patent: Aug. 11, 1992

[54] FOREIGN MATTER ELIMINATOR FOR LAWN WATERING SYSTEMS

[76] Inventor: Walter J. Kinsey, 246 Mermaids Bite, Naples, Fla. 33940

[21] Appl. No.: 709,094

[22] Filed: May 31, 1991

[51] Int. Cl.[5] ..... B05B 15/10

[52] U.S. Cl. ..... 285/156; 239/201; 239/203; 285/423

[58] Field of Search ..... 285/156, 189, 239, 423, 285/417, 418, 390; 239/200, 201, 202, 204, 205, 206, 207, 268, 288, 288.3, 288.5, 203

[56] References Cited

U.S. PATENT DOCUMENTS

| | | | |
|---|---|---|---|
| 3,331,292 | 7/1967 | Seablom | 239/203 |
| 3,759,445 | 9/1973 | King | 239/201 |
| 4,314,717 | 2/1982 | Bjurman | 239/201 |
| 4,353,506 | 10/1982 | Hayes | 239/206 |
| 4,393,992 | 7/1983 | Strunk et al. | 239/200 |
| 4,429,832 | 2/1984 | Sheets | 239/204 |
| 4,562,962 | 1/1986 | Hartman | 239/200 |
| 4,687,139 | 8/1987 | Lockwood | 239/205 |
| 4,752,033 | 6/1988 | Groendyke | 239/288 |
| 4,781,327 | 11/1988 | Lawson et al. | 239/203 |
| 4,834,292 | 5/1989 | Dyck | 239/204 |
| 4,901,890 | 2/1990 | Mivelaz | 239/201 |
| 4,961,534 | 10/1990 | Tyler et al. | 239/205 |
| 4,986,474 | 1/1991 | Schisler et al. | 239/205 |

*Primary Examiner*—Eric K. Nicholson
*Attorney, Agent, or Firm*—Merrill N. Johnson

[57] ABSTRACT

A one piece molded combination retaining housing and tee, and a one piece molded combination retaining housing and 90° elbow, for new installations of lawn watering systems, and a separate retaining housing for use with conventional tees and 90° elbows in existing or new installations of lawn watering systems, to eliminate foreign matter from entering into the underground water piping system when a pop-up head is removed for repair or replacement. Adapters, to increase the height of the retaining housings, and retaining housing caps to allow standardization of the retaining housings of these three parts are also a part of the invention. All parts would be made of PVC today, but the material would not be limited to PVC.

24 Claims, 8 Drawing Sheets

FIG. 4
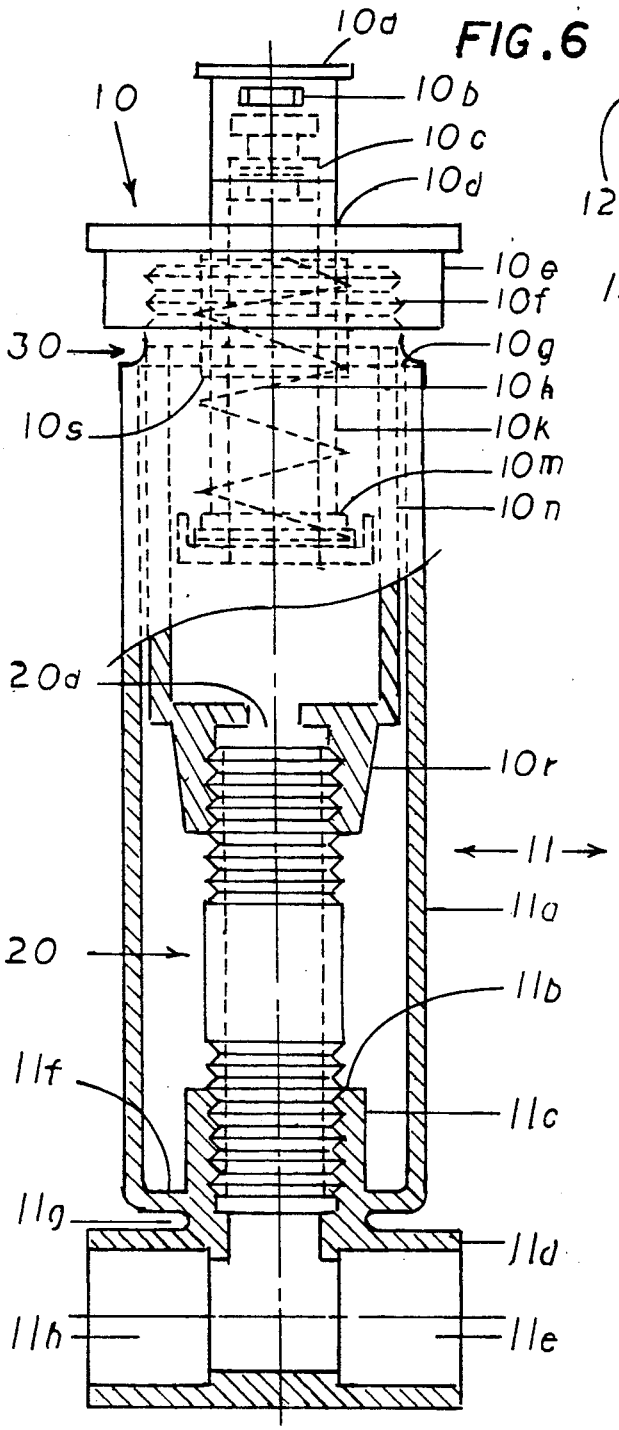
FIG. 6
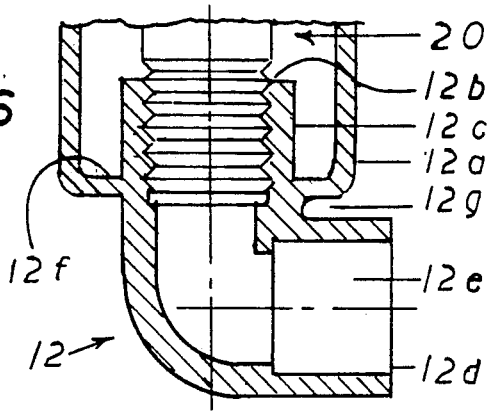
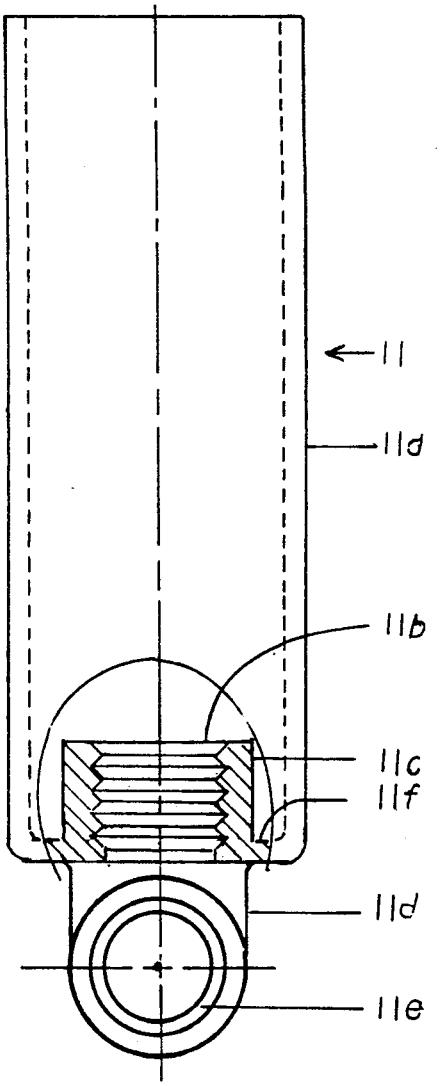
FIG. 5

FIG. 7
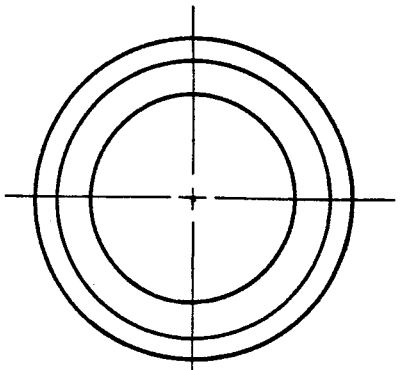
FIG. 9
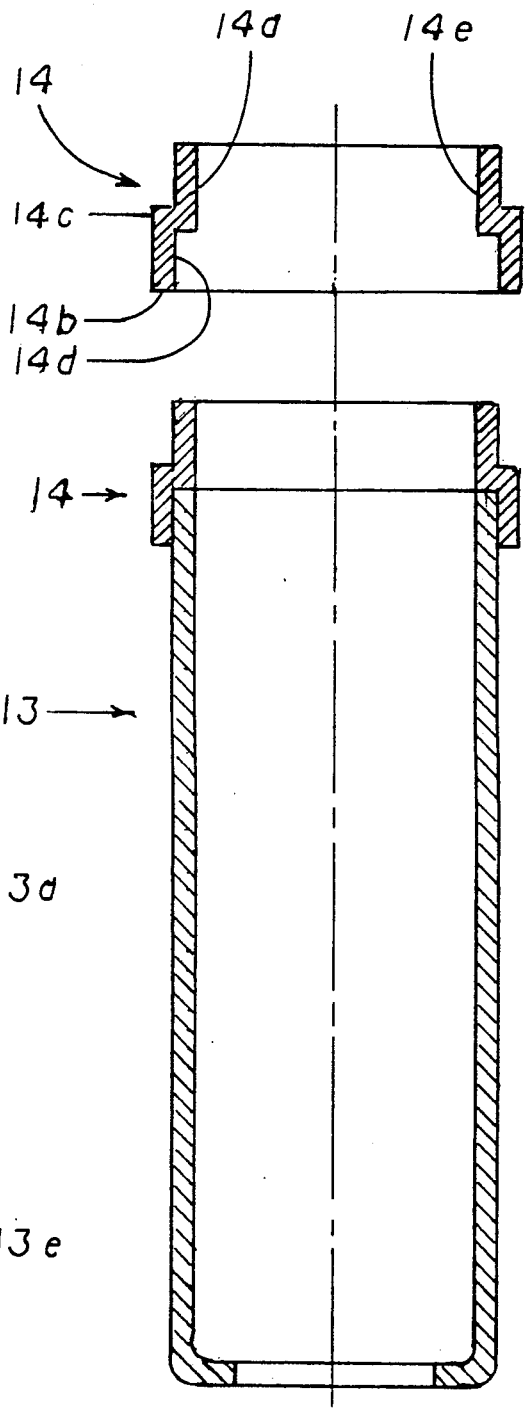
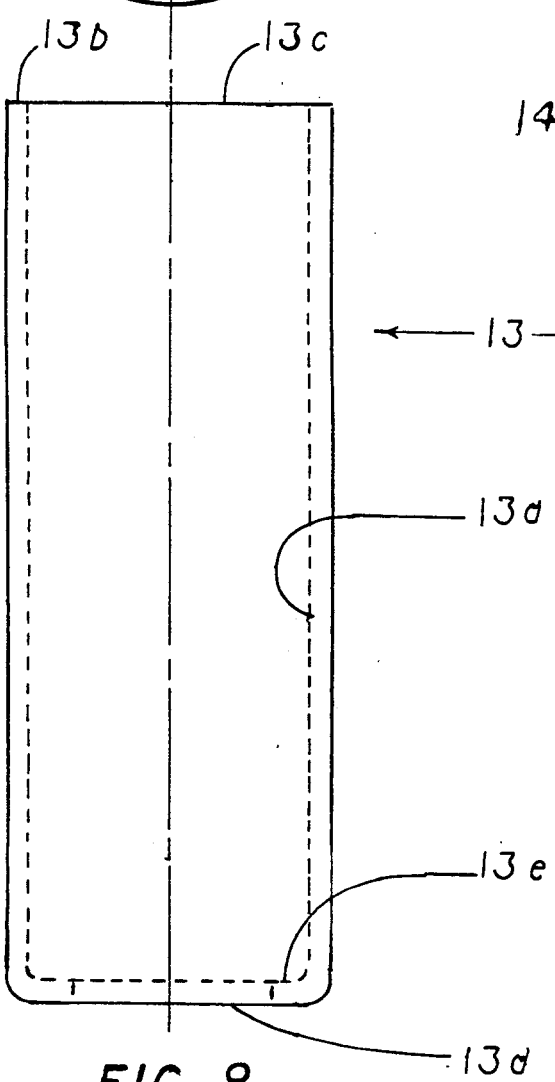
FIG. 8
FIG. 10

FOREIGN MATTER ELIMINATOR FOR LAWN WATERING SYSTEMS

BACKGROUND AND SUMMARY OF THE INVENTION

My invention lies in the field of plumbing, particularly lawn watering systems.

Most lawn watering systems employing pop-up watering heads consist of two or more water piping lines having conventional tees at intervals, determined by the designed watering pattern. Instead of having a tee at the end of each line, a 90° elbow is generally used.

These tees have a slip-fit opening at each end and a threaded riser. The 90° elbow has one slip-fit end and a threaded riser. The pipe used to make the line, and the tees and elbows are made of PVC, and are joined together by PVC cement. Each water piping line is placed in a trench in the lawn area it is designed to water. These lines will be referred to as the underground water piping system.

The beginning end of each water piping line is connected to a cycling device, which in turn is connected to the incoming water supply. The flow of water to each water piping line is controlled by an electric clock, which activates the cycling device by a solenoid or solenoids.

The pop-up heads are connected to the tees and 90° elbow by pipe nipples of varying length to make the top of each head flush with the ground surface.

It is most important in installing the water piping lines, and after the system is complete and operating, to keep any foreign matter from entering the underground water piping system.

Keeping the underground water piping system free of foreign matter during installation of the water piping lines, the pipe nipples, and the pop-up heads is simply a matter of care. However, once the lawn watering system is complete and operating, potential problems exist in pop-up watering heads when foreign matter, such as soil, sand and debris enter the pop-up head either through the nozzle opening or through the area between the outside diameter of the pop-up cylinder and the hole in the cover through which it rises and retracts. This foreign matter may partially clog or completely clog the nozzle opening and may score the outside of the pop-up cylinder and the sides of the hole in the cover through which it rises and retracts keeping the pop-up cylinder from rising to its required operating level.

An additional potential problem is the nozzle's unscrewing from the pop-up cylinder and allowing sand, soil, small stones and debris to enter the pop-up head.

Correcting any of these problems requires unscrewing the pop-up head cover, in which the pop-up cylinder and nozzle are assembled, from the head casing.

Most times the cover's threaded connection is the tightest of three system threaded connections—the other two being the threaded connection of the pop-up head to the pipe nipple and the pipe nipple to the tee or 90° elbow making it impossible to unscrew the cover by hand.

There are two alternatives—one being grasping the cover and turning the whole pop-up head, thereby unscrewing the entire head from the nipple, or the pipe nipple from the tee or 90° elbow depending upon which is the tighter. Either removal point allows the surrounding soil, sand, small stones and debris to enter the underground water piping system resulting in other pop-up heads further down the line being clogged or scored, thus exacerbating the problem.

The other alternative is to remove sufficient sod, soil, sand, and stones from around the pop-up head to allow the casing and cover to be grasped by wrenches to remove the pop-up head cover. This is a time consuming job and lawn marring operation and, of course, this method cannot be used if the whole pop-up head must be replaced.

The way to keep foreign matter, such as soil, sand, small stones, and debris from entering into the underground water piping system when a pop-up head is removed for repair or replacement is to have a barrier between the threaded riser of the tee or 90° elbow, the pipe nipple connecting the head to the threaded riser of the tee or 90° elbow, and the casing of the pop-up head, with the barrier encasing almost all of the casing by extending to within a short distance of the cover of the pop-up head, leaving only sufficient space to place a wide rubber band around the top of the retaining housing and the casing, to seal the slight circumferential area between them—the casing being my generic name for the outside shell of the pop-up head which has the threaded entrance in the bottom, to which the pipe nipple is connected, and a threaded top to which the cover is connected.

There is no such barrier on the market.

My invention not only creates such a barrier, but several versions of that barrier, with all parts being molded of PVC or other plastic material by conventional methods.

The basic building block of my invention is a retaining housing which is about 40% longer than the pop-up head with a wall thickness not greater than the wall thickness of the slip-fit opening of the conventional tee and 90° elbow used in lawn watering systems.

The conventional tee and 90° elbow used in lawn watering systems are also used. They are, however, modified.

Another building block is an adapter to add height to the retaining housing if additional height is required to bring the height of the retaining housing to within the short distance of the pop-up head cover required.

Another building block is a retaining housing cap which makes it possible for only three different diameter retaining housings to be used for the many different pop-up heads manufactured, thus allowing standardization of the retaining housings which would lower the cost for the manufacturer, and reduce the inventory which would have to be carried by the wholesalers and retailers, resulting in a lower cost to the consumer.

The first version is—a one piece molded combination retaining housing and tee, and one piece molded retaining housing adapters.

The tee portion will be the same as the conventional tee used in lawn watering systems, but with the threaded riser being a little longer than the slip-fit opening.

The inside diameter of the retaining housing would be slightly greater than the outside diameter of the casing of the pop-up head for which this part would be made—just large enough to allow free turning of the pop-up head within the retaining housing.

The length of the retaining housing would be about 40% longer than the pop-up head, to allow for the pipe nipple and still have the retaining housing encase all, or at least part, of the casing of the pop-up head.

The wall thickness of the retaining housing may be the same as the wall thickness of the slip-fit opening of the tee if desired for molding purposes.

However, if a thinner wall may be molded the wall thickness may be thinner, since there is no water pressure against the wall, but only the slight pressure of the soil, sand, and stones which surround the retaining housing. Making the wall thinner would, of course, result in the consumer paying less for the part.

At times a pop-up head is hit by a lawn mower, and sometimes that impact is sufficient to move the pop-up head from its normal vertical position. Generally the tee is not damaged since the pipe nipple having flexibility simply pulls out of the tee or the pop-up head. Foreign matter, of course, enters the underground water piping system.

To assure that the tee is not damaged using my invention, since the retaining housing of the one piece molded combination retaining housing and tee would add rigidity to the pop-up head and pipe nipple, there will be a space in the one piece molding between the bottom of the retaining housing and the top of the slip-fit portion of the tee. This will allow the retaining housing to either bend or crack where it joins the outside of the threaded riser of the tee. If it bends or cracks, it may be bent back. Any foreign matter which might enter through the crack will not cause a problem since it will be below the top of the threaded riser of the tee.

An alternative would be to not have this space between the retaining housing and the top of the slip-fit portion of the tee, but rather have the bottom of the retaining housing and the slip-fit portion of the tee form an integral wall, since if a system is properly installed and maintained, and care is taken in mowing the lawn, the movement of a pop-up head should not occur.

Covers similar to the flexible plastic covers used on coffee cans would be used to cover the top of the retaining housings during installation.

It is nigh on to impossible, and certainly not cost effective, to install the underground water piping system at a precise depth below ground level.

The varying depths of the tees and 90° elbows in the conventional system cause no problem. The pop-up heads are simply installed so that their tops are flush with the ground level by using varying lengths of pipe nipples.

The pop-up heads will still be set at their proper level in the same manner using my invention. However, the pipe nipple and the pop-up head will be installed within the retaining housing, but installed temporarily.

Upon this temporary installation, the height of the top of the retaining housing will be marked on the casing of the pop-up head.

The pop-up heads will then be removed and the height each retaining housing must be increased to bring it to its required level will be recorded—this required level being, as close to the cover of the pop-up head as possible, and still allow a wide rubber band to be placed around the top of the retaining housing and casing to seal the slight circunferential opening between them.

The height of each retaining housing will be increased by adding an adapter or adapters. These adapters would have a wall thickness the same as the wall thickness of the retaining housing, except where the diameters change the wall thickness would be double for a short distance, with one end sized to slip-fit over the end of the retaining housing, and the other end having the same inside diameter as the inside diameter of the retaining housing.

The adapters will be made to add six different lengths, namely ¼", ½", ¾", 1", 2", and 3".

After each retaining housing is brought to its required height by adding an adapter or adapters, the pop-up head will be reinstalled and a wide rubber band placed around the top of the retaining housing adapter and casing of the pop-up head, to seal the slight circumferential area between them.

I would like to state that while slip-fitting is well known and widely used, there has never been on the market, a one piece slip-fitting part, such as my adapter, to add short lengths to a pipe or other cylindrical shapes. It may readily be seen how important my invented adapter is to my overall invention.

There may be occasions when the retaining housing is too long, because the underground water piping system has been set close to the ground level.

When this happens, the retaining housing may be cut off by a hand PVC cutter, after a long pipe nipple has been attached to the tee to keep cutting swirls from entering the underground water piping system. Any cutting swirls dropping to the bottom of the retaining housing may be removed with a long nose tool.

Now that we know that there is no foreign matter in the underground water piping system and no soil, sand, small stones, and debris in contact with the threaded riser of the tee, the pipe nipple and most of the pop-up head, how do we make sure that the soil, sand, small stones, and debris which is in contact with the wide rubber band and cover of the pop-up head will not enter the system when we remove a pop-up head for repair or replacement?

To remove a pop-up head, a garden trowel would be placed against the outside diameter of the cover of the pop-up head in several places, and pushed down to just below the bottom of the wide rubber band, and the handle pushed away from the cover, thus forming a "V" in the surrounding soil or sand, but not eroding it.

The cover and the wide rubber band would be brushed clean by a small paint brush, and then the rubber band would be removed. The pop-up head could then be removed without any soil, sand, small stones, and debris entering the underground water piping system. The retaining housing, of course, would be covered by a flexible plastic cover while the pop-up head is being repaired.

In presenting the other five versions of my invention, I will not repeat the specifications and discussion of the "one piece molded combination retaining housing and tee," where they apply to the other five versions as well.

I will state only the specifications which are different, and what those differences are.

The second version is—a one piece molded combination retaining housing and 90° elbow, and one piece molded retaining housing adapters.

The only difference in this version is that a conventional 90° elbow used in lawn watering systems, but with the threaded riser being a little longer than the slip-fit opening is used, instead of the conventional tee with the longer threaded riser.

The third version is—a one piece molded retaining housing, and one piece molded retaining housing adapters.

In this version the retaining housing has a hole in the bottom slightly larger than the outside diameter of the threaded riser of a conventional tee and 90° elbow used in lawn watering systems. In use, the hole in the bottom of the retaining housing slides over the conventional tee or 90° elbow already installed in the underground water piping system, and comes to rest on the top of the slip-fit area of the tee or 90° elbow.

The very slight circumferential open area between the hole in the retaining housing and the threaded riser of the tee or 90° elbow will allow the retaining housing to move if the pop-up head were hit by a lawn mower, thus the threaded riser of the tee or 90° elbow would not be damaged.

Any fine foreign matter which might enter the very slight open area will not enter the underground water piping system, since any fine foreign matter which did enter would be below the threaded riser opening of the tee or 90° elbow.

The fourth version is—a one piece molded combination retaining housing and tee, one piece molded retaining housing adapters, and a one piece molded retaining cap.

While the tee portion is the same, the length of the retaining housing is the same, and the wall thickness options of the retaining housing are the same, there need be only three inside diameters of the retaining housing—one for small diameter pop-up heads, one for medium diameter pop-up heads, and one for large diameter pop-up heads, rather than many different inside diameters—one for each casing diameter, of all of the pop-up heads manufactured.

The required slightly greater inside diameter of the retaining housing than the outside diameter of the casing of the pop-up head required, to just allow free turning of the pop-up head within the retaining housing would be obtained by molded retaining housing caps.

Caps would be made for each of the three diameter retaining housings with one end slip-fitting over the top of the retaining housing, or its adapter.

The other end would be sized for each casing diameter of pop-up heads manufactured, and the height of this end would be only that required for placing the wide rubber band around the cap and the casing.

The wall thickness of the caps would be the same as the retaining housing.

Determining the required height of the retaining housing would be done in the same manner, and an adapter or adapters added if required. However, the cap height must be considered since the cap must be slip-fitted to the adapter, or to the retaining housing if no adapter is required.

The fifth version is—a one piece molded combination retaining housing and 90° elbow, one piece molded retaining housing adapters, and a one piece molded retaining housing cap.

This is exactly the same as the fourth version, except that a conventional 90° elbow used in lawn watering systems, but with the threaded riser being a little longer than the slip-fit opening, is used instead of the conventional tee with the longer threaded riser.

The sixth version is—a one piece molded retaining housing, one piece molded retaining housing adapters, and a one piece molded retaining housing cap.

In this version, the retaining housing has a hole in the bottom slightly larger than the outside diameter of the threaded riser of the conventional tee and 90° elbow used in lawn watering systems.

In use, the hole in the bottom of the retaining housing slides over the conventional tee or 90° elbow already installed in the underground water piping system, and comes to rest on the top of the slip-fit area of the tee or 90° elbow.

The very slight circumferential open area between the hole in the retaining housing, and the threaded riser of the tee or 90° elbow will allow the retaining housing to move if the pop-up head were hit by a lawn mower, thus the threaded riser of the tee or 90° elbow would not be damaged.

Any fine foreign matter which might enter the very slight open area will not enter the underground water piping system, since any fine foreign matter which might enter would be below the threaded riser opening of the tee or 90° elbow.

While the length of the retaining housing is the same, and the wall thickness options are the same, there need be only three inside diameters, one for small diameter pop-up heads, one for medium diameter pop-up heads, and one for large diameter pop-up heads, rather than many different inside diameters—one for each casing diameter of all of the pop-up heads manufactured.

The required slightly greater inside diameter of the retaining housing than the outside diameter of the casing of the pop-up head required for free turning of the pop-up head within the retaining housing, would be obtained by molded retaining housing caps.

Caps would be made for each of the three diameter retaining housings with one end slip-fitting over the top of the retaining housing, or its adapter.

The other end would be sized for each casing diameter of pop-up heads manufactured, and the height of this end would be only that required for placing the wide rubber band around the cap and the casing.

The wall thickness of the caps would be the same as the retaining housing.

Determining the required height of the retaining housing would be done in the same manner, and an adapter or adapters added if required. However, the cap height must be considered since the cap must be slip-fitted to the adapter, or to the retaining housing if no adapter is required.

Versions one and two would offer the most economical new installation, provided the decision was firm as to the diameter of pop-up heads which would be used.

Version three would allow conversion to the retaining housing concept for the vast number of lawn watering systems already installed.

Versions four, five and six offer the best opportunity for future standardization, since only three diameters of retaining housings would have to be manufactured to accomodate all pop-up heads manufactured.

It should be understood that while I have referred only to pop-up heads, other types of heads also could use these six versions of my invention.

BRIEF DESCRIPTION OF THE DRAWINGS

In the appended drawings I have illustrated embodiments of my foreign matter eliminator for lawn watering systems. All of the parts are molded of PVC or other plastic material

FIG. 4 is the front view of the molded one piece combination retaining housing and tee with the pop-up head in place, and pipe nipple connecting the pop-up head to the tee.

The lower part of this figure is a cross-sectional view taken through the center. The pipe nipple, however, which forms no part of the invention is not sectionalized.

All of the details of the pop-up head are not shown since the pop-up head forms no part of this invention. Only the details required to show and explain the potential problem areas are shown.

FIG. 5 is the side view of the molded one piece combination retaining housing and tee. The threaded riser of the tee is sectionalized through the center.

FIG. 6 is the front view sectionalized through the center of only the 90° elbow portion of the molded one piece combination retaining housing and 90° elbow—the retaining housing being the same as shown in FIG. 4. The part of the nipple shown, however, which forms no part of the invention, is not sectionalized.

FIG. 7 is the top view of the molded one piece retaining housing for use with conventional tees and 90° elbows.

FIG. 8 is the front view of the molded one piece retaining housing for use with conventional tees and 90° elbows.

FIG. 9 is a front view sectionalized through the center of a retaining housing adapter to add height to the retaining housing of FIG. 1, FIG. 2, FIG. 3, FIG. 4, FIG. 5, FIG. 6, and FIG. 8, if required.

FIG. 10 is a front view sectionalized through the center of the adapter FIG. 9 slip-fitted to the top of the retaining housing of FIG. 8.

Figure 11:
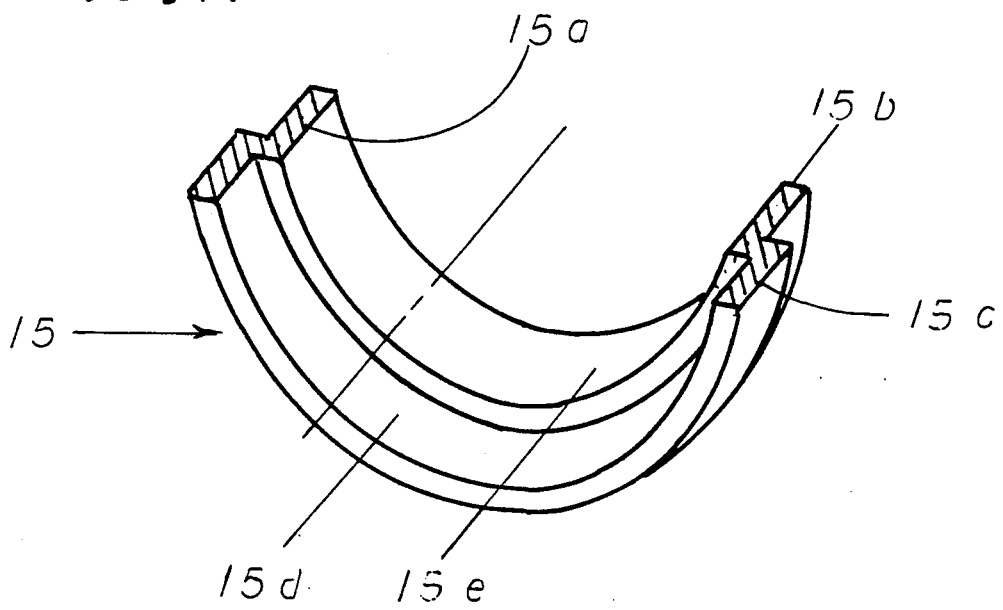
Figure 13:
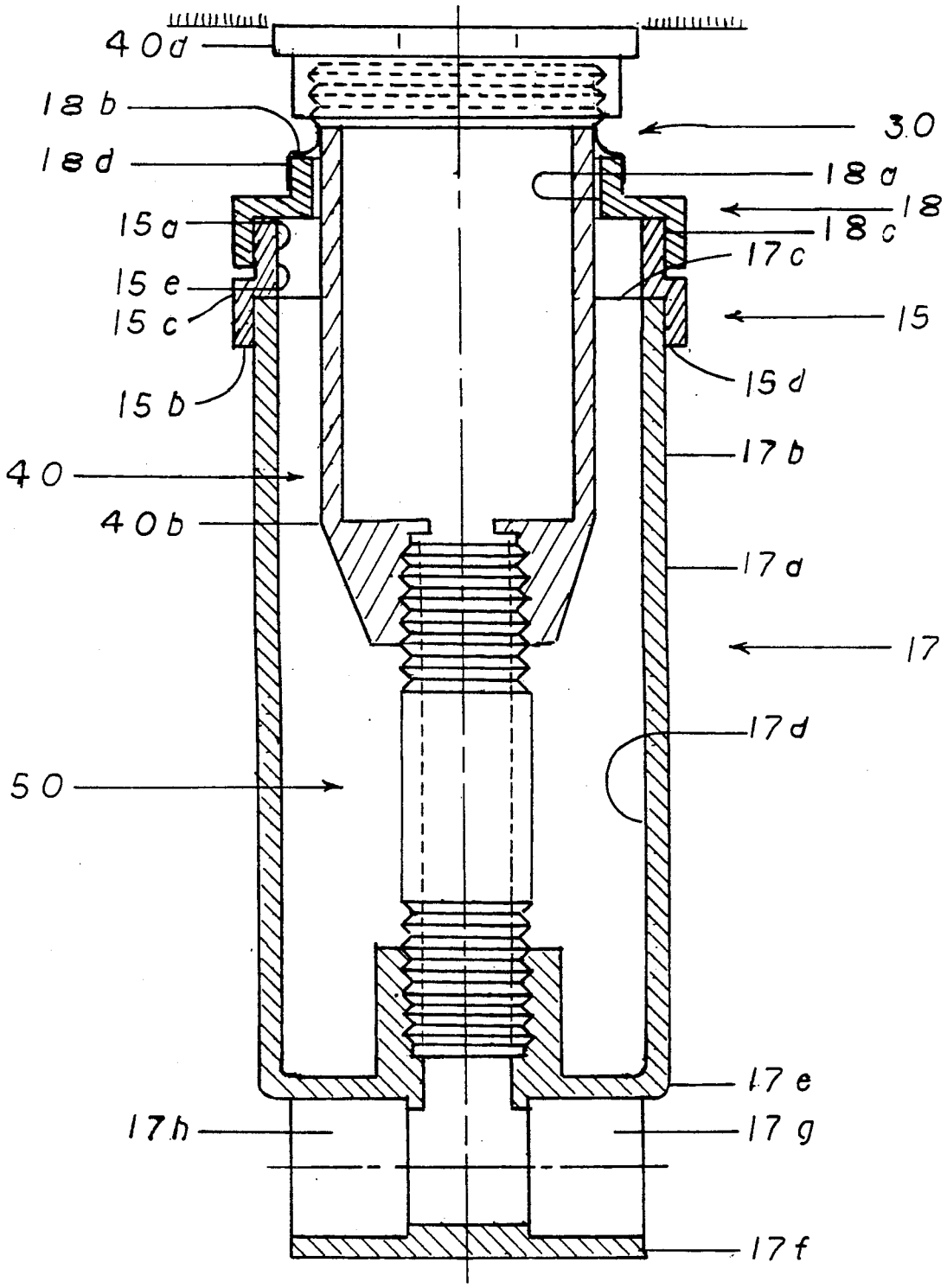
Figure 14:
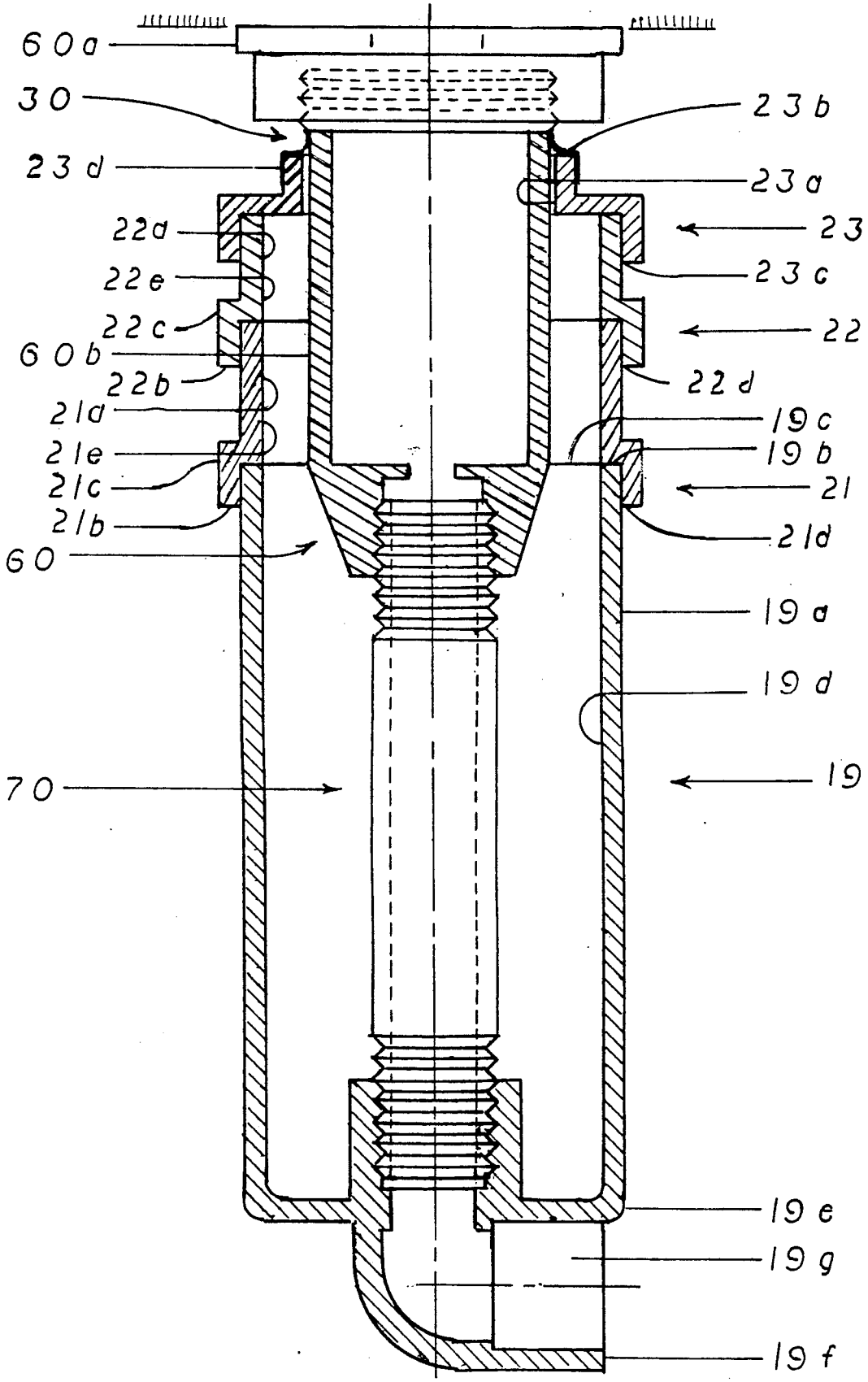
Figure 15:
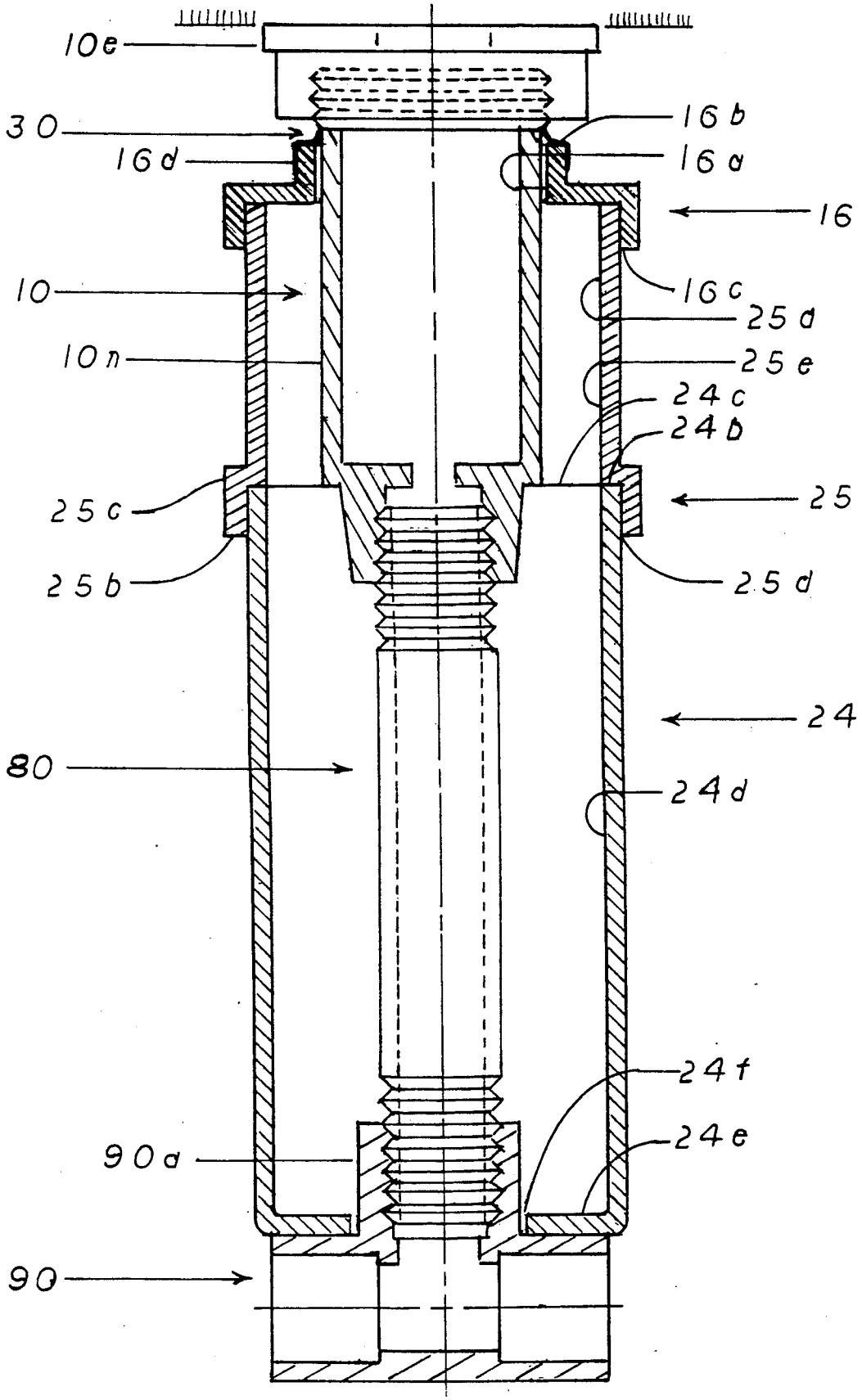

FIG. 11 is a perspective view of a section taken through the center of a retaining housing adapter to add height to the retaining housing of FIG. 13, FIG. 14, and FIG. 15, if required. It will be noted that the only difference between this adapter, and the adapter of FIG. 9 and FIG. 10 is that the diameters are greater.

Figure 12:
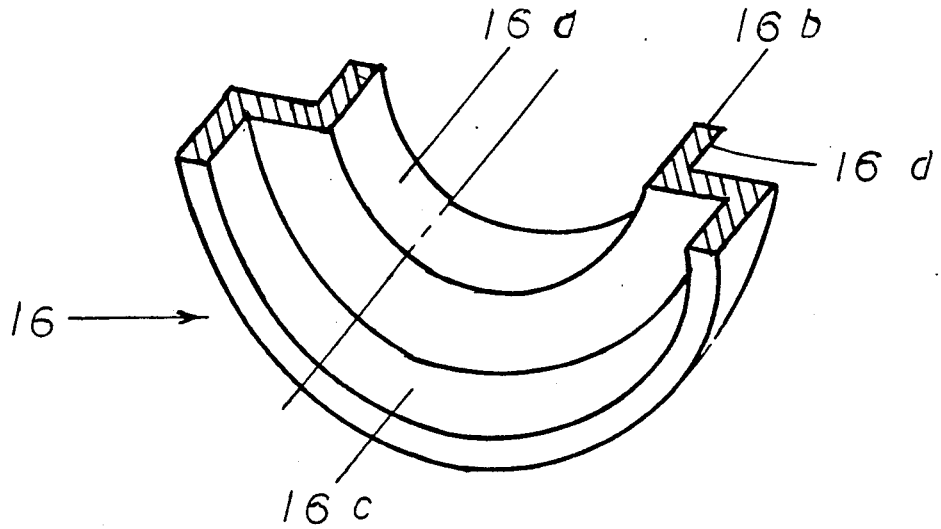

FIG. 12 is a perspective view of a section taken through the center of a retaining housing cap. Its use is shown in FIG. 13, FIG. 14, and FIG. 15.

FIG. 13, FIG. 14, and FIG. 15 show three different diameters of casings of pop-up heads, using the diameter of the retaining housing for small diameter pop-up heads as covered by versions four, five, and six.

Only the casings and covers of the pop-up heads are shown, since they are all that is necessary to illustrate the use of the one diameter retaining housing, the retaining housing adapters, and the retaining housing caps.

The casings and covers, and the pipe nipples form no part of the invention.

FIG. 13 is the front view of the molded one piece combination retaining housing and tee, with an adapter and retaining housing cap, and a casing and cover of a small diameter pop-up head, a pipe nipple, and a wide rubber band.

The cover and pipe nipple, are not sectionalized. The balance is sectionalized through the center.

The bottom of the retaining housing, and the top of the slip-fit area of the tee form an integral wall.

As previously stated, rather than having an integral wall there may be a space between the bottom of the retaining housing, and the top of the slip-fit opening of the tee.

FIG. 14 is the front view of the molded one piece combination retaining housing and 90° elbow, with two adapters and retaining housing cap, and a casing and cover of a smaller diameter pop-up head, a different length pipe nipple, and the wide rubber band.

The cover and pipe nipple are not sectionalized. The balance is sectionalized through the center.

The bottom of the retaining housing, and the top of the slip-fit area of the 90° elbow form an integral wall. Here again, the integral wall is not a necessity.

FIG. 15 is the front view of the molded one piece retaining housing, with an adapter and retaining housing cap, and a casing and cover of a still smaller diameter pop-up head—the one shown in FIG. 4—a different length pipe nipple, and a wide rubber band.

The cover and pipe nipple, are not sectionalized. The balance is sectionalized through the center.

DETAILED DESCRIPTION OF THE PREFERRED EMBODIMENT

Figure 1:
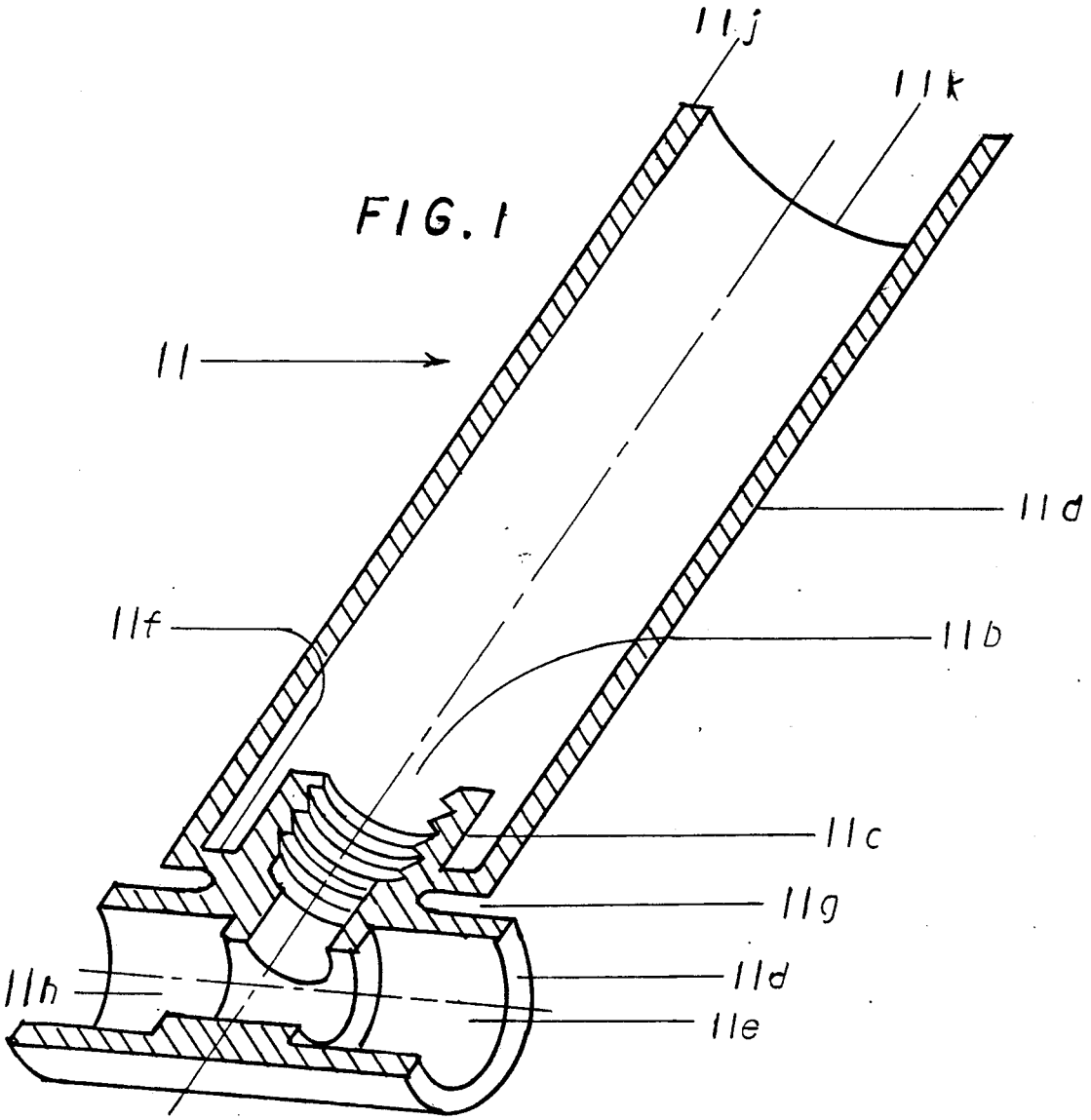
FIG. 1 is a perspective view of the section taken through the center of the molded one piece combination retaining housing and tee, for new installations.

FIG. 1 is a perspective view of the molded one piece combination retaining housing and tee 11 cross sectioned through the center, for use in new installations.

While 11 would be made of PVC today, the material is not limited to PVC.

The retaining housing portion 11*a* would have an inside diameter slightly larger than the outside diameter of the casing of the pop-up head to allow free turning of the pop-up head.

The wall thickness 11*j* of the retaining housing could be the same thickness as the slip-fit areas 11*e* and 11*h*, or less if material savings would be significant since the retaining housing 11*a* would not be subjected to water pressure, but only the slight pressure of the soil, sand, and stones which would surround it.

The height 11*k* of the retaining housing would be about 40% longer than the pop-up head to allow for the connecting pipe nipple.

The tee portion 11*d* would have the same dimensions as the conventional tee, except the height of the threaded riser 11*c* would be a little longer than the slip-fit area, There would be a space 11*g* between the bottom 11*f* of the retaining housing 11*a* and the top of the slip-fit area of the tee 11*d* to allow movement of the retaining housing and pop-up head and pipe nipple in case the pop-up head were hit by a lawn mower. This movement would prevent damage to the threaded riser 11*c* of the tee 11*d*. Even if the bottom 11*f* should crack, no foreign matter would enter the underground water piping system at 11*b* since that point of entrance of soil or sand would be below 11*b*.

Rather than have space 11*g*, the bottom 11*f* and the top wall of slip-fit areas 11*e* and 11*h* of tee 11*d*, could be an integral wall. This alternative is shown in FIG. 13.

The ends of the underground piping which forms no part of this invention and the slip-fit areas 11*e* and 11*h* would be coated with PVC cement and joined, slip-fitting one to the other—a standard procedure.

Figure 2:
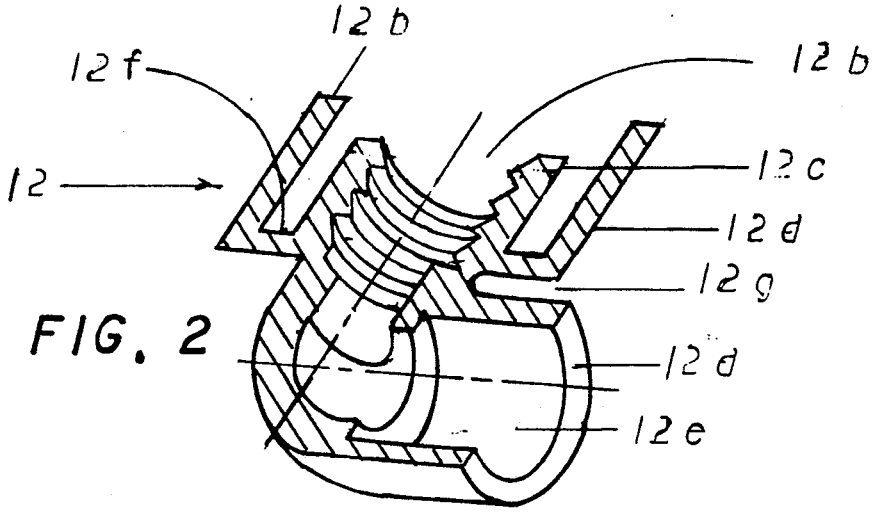
FIG. 2 is a perspective view of the section taken through the center of only the 90° elbow portion of the molded one piece combination retaining housing and 90° elbow for new installations—the retaining housing portion being the same as FIG. 1.

FIG. 2 is a perspective view of the lower portion of the molded one piece combination retaining housing and 90° elbow 12 cross sectioned through the center, for use in new installations.

While 12 would be made of PVC today, the material would not be limited to PVC.

The retaining housing portion 12*a* would have an inside diameter slightly larger than the outside diameter of the casing of the pop-up head to allow free turning of the pop-up head.

The wall thickness 12*h* of the retaining housing could be the same thickness as the wall of area 12*e*, or less if material savings would be significant since the retaining housing 12*a* would not be subjected to water pressure, but only the slight pressure of the soil, sand, and stones which would surround it.

The height of retaining housing 12*a* would be about 40% longer than the pop-up head to allow for the connecting pipe nipple.

The 90° elbow portion 12*d* would have the same dimensions as the present day conventional 90° elbow, except the height of the threaded riser 12*c* would be a little longer than the slip-fit area.

There would be a space 12*g* between the bottom 12*f* of the retaining housing 12*a* and the slip-fit portion of 90° elbow 12*d* to allow movement of the retaining housing and pop-up head and pipe nipple in case the pop-head were hit by a lawn mower. This movement would prevent damage to the threaded riser 12*c* of 90° elbow 12*d*. Even if the bottom 12*f* should crack, no foreign matter would enter the underground water piping system at 12*b* since that point of entrance of soil or sand would be below 12*b*.

Rather than have space 12*g*, the bottom 12*f*, and the top wall of slip-fit area 12*e* of 90° elbow 12*d* could be an integral wall. This alternative is shown in FIG. 14.

The ends of the underground pipes which form no part of the invention and the slip-fit area 12*e* would be coated with PVC cement and joined, slip-fitting one to the other—a standard procedure.

Figure 3:
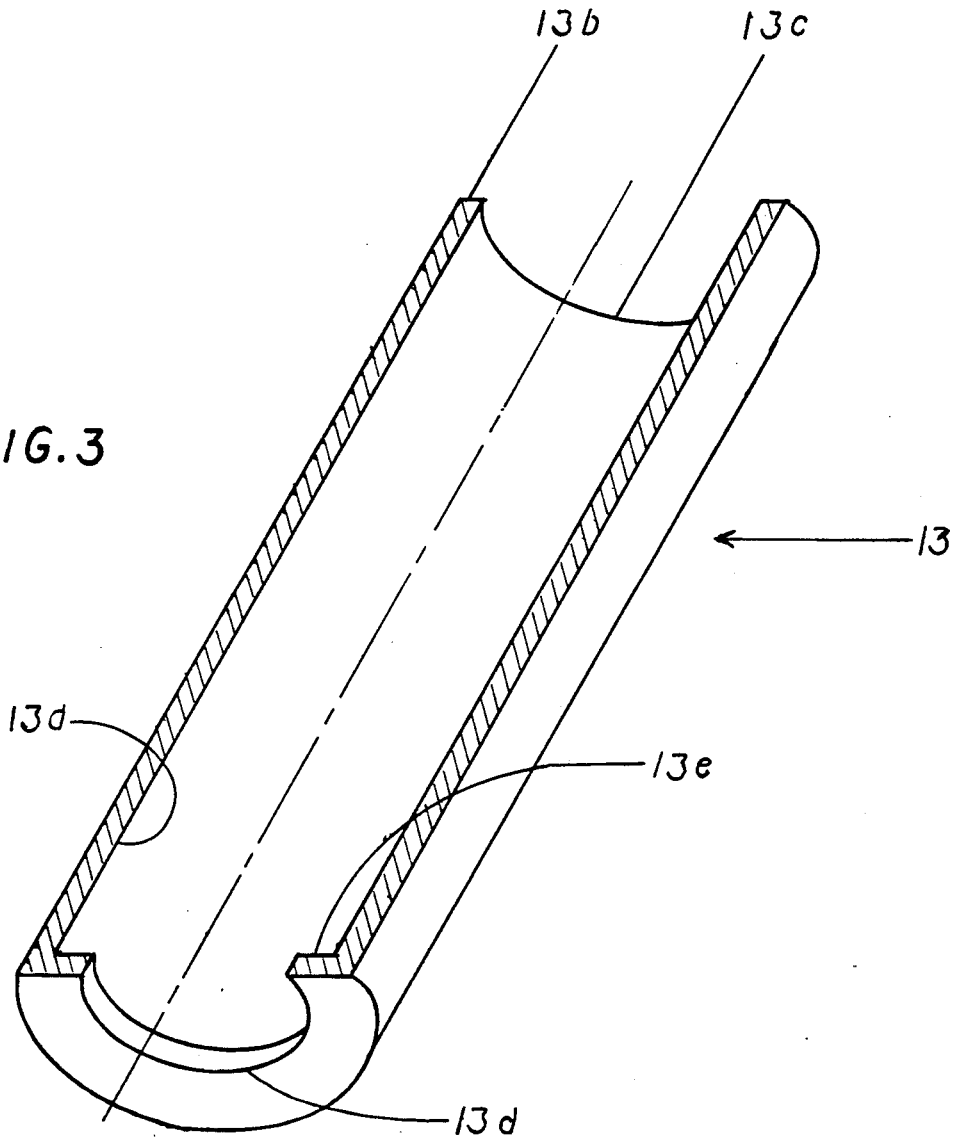
FIG. 3 is a perspective view of the section taken through the center of the molded one piece retaining housing for use with conventional tees or 90° elbows.

FIG. 3 is a perspective view of the molded retaining housing 13 cross sectioned through the center, for use with conventional tee and 90° elbow already installed in the underground water piping system.

The molded retaining housing 13 would be made of PVC, but the material would not be limited to PVC.

The retaining housing would have an inside diameter 13*a* slightly larger than the outside diameter of the casing of the pop-up head to allow free turning of the pop-up head.

The wall thickness 13*b* of the retaining housing would be the same as that of the retaining housing of FIG. 1 and FIG. 2, to allow standardization of the retaining housing adapters.

The height of the retaining housing 13*c* would be about 40% longer than the pop-up head to allow for the connecting pipe nipple.

The retaining housing 13 would have a hole 13*d* with a diameter slightly larger than the outside diameter of the threaded riser of the conventional tee and 90° elbow in the bottom 13*e*.

The retaining housing 13 would be placed over the threaded riser of the conventional tee or the 90° elbow and rest on the top of the tee or 90° elbow.

This space between the hole 13*d* and the tee or 90° elbow would allow movement of the retaining housing and the pop-up head and pipe nipple, in the event the head were hit by a lawn mower.

Any soil or sand that would enter through the narrow circumferential area between the hole 13*d* and the tee or the 90° elbow would not enter the underground water piping system, since the bottom of the retaining housing 13*e* would be below the opening in the threaded riser of the tee or the 90° elbow.

FIG. 4 is the front view of the molded one piece combination retaining housing and tee 11 with the pop-up head 10 connected to the pipe nipple 20 at 10*r*, and the other end of the pipe nipple 20 connected to the threaded riser 11*c* of the tee 11*d*.

The only difference between the retaining housing and tee as shown in FIG. 1, is that the inside and outside corners of bottom 11*f* are slightly rounded to aid in mold release if required.

11*g* is the space which allows movement of retaining housing 11*a* in the event the head were hit by a lawn mower. Again, the alternative of an integral wall could be used.

While the pop-up head 10 forms no part of the invention, it is necessary to understand how it operates to understand the problems caused by soil, sand, and debris entering the pop-up head, and how soil, sand, small stones, and debris enter the underground water piping system today, and how the invention will eliminate that intrusion.

When the watering system is operating, water flows in 11*e*, some goes to other watering heads through 11*h*, and some supplies the head pipe nipple 20. The water forces pop-up cylinder 10*k* upwards in 10*n*, bringing rubber washer 10*m* in contact with surface 10*s* of cover 10*e*, thus the water flows through pop-up cylinder 10*k* and out nozzle 10*b* in a spray pattern.

When the water is shut off by the solenoid at the water source—not shown and not a part of the invention—the spring 10*h* forces the pop-up cylinder 10*k* down, and the top of nozzle 10*a* becomes flush with the top of cover 10*e*.

When the nozzle and cover are in this flush position, which they are about 99% of the time, soil, sand, and grass clippings, and other debris many times accumulate on this surface. In addition, since there is a circumferential small opening at 10*d* soil and sand can enter this area.

When the water pressure again activates the pop-up head, this soil or sand scores the outside surface of cylinder 10*k* and the surface of the hole in cover 10*e*, through which it rises and retracts. When the pop-up cylinder 10*k* retracts it takes any accumulated soil or sand in area 10*d* with it, thus scoring the surfaces again. In addition, debris may enter nozzle opening 10*b* during the retraction. After repeated operation of the pop-up cylinder, nozzle 10*b* may become partially or totally clogged, and the cylinder 10*k* will not rise to its operating position due to the scoring by soil and sand of the pop-up cylinder 10*k* and the hole in cover 10*e*.

In addition, at times nozzle 10*a* unscrews from cylinder 10*k* at threads 10*c*. This allows soil, sand and debris to enter cylinder 10*k* and settle on the bottom of casing 10*n*. Some may enter the piping system at 20*a*. Luckily this does not happen often.

These foreign matter intrusions require either the repair of the pop-up head 10 which most times requires its removal, because the head 10*e* cannot be unscrewed by hand at threaded area 10*f* or replacement of the head.

The unscrewing of the pop-up head will occur at either 10*r* or 11*c* depending upon which end of the nipple 20 threads are the more tightly engaged. Without the invention, this allows the soil, sand, small stones, and other debris surrounging the pop-up head 10, the nipple 20, and the threaded riser 11*c* to enter the underground water piping system at 20*a* or 11*b*.

The invention prevents the entrance of all foreign matter into the underground water piping system since the pop-up head 10, the nipple 20, and the threaded riser 11*c* have no soil, sand, small stones, and other debris in contact with them. This foreign matter is against the retaining housing. All that is necessary to remove the pop-up head is to insert a small trowel in several places around the cover 10*e* to slightly below wide rubber band 30, which keeps any foreign matter from entering the area 10*g* between casing 10*n* and retaining housing 11*a*, and press back the surrounding soil or sand sufficiently to allow brushing the cover and rubber band, and then removing rubber band 30 and cover 10*e*.

FIG. 5 is the side view of the molded one piece combination retaining housing and tee 11 partially cross sectioned. All details of this were covered in the FIG. 4 details.

FIG. 6 is the front view of the lower portion of the molded one piece combination retaining housing and 90° elbow 12 cross sectioned through the center. The pipe nipple which forms no part of the invention is not cross sectioned.

All details were covered in FIG. 4. The only difference is that the 90° elbow replaces the tee, therefore, the water flows only to the pop-up head in this one piece combination retaining housing and 90° elbow.

FIG. 7 and FIG. 8 are the top view and front view respectively of the molded retaining housing 13 for use with the conventional tee and 90° elbow.

The only difference between the retaining housing shown in FIG. 3 is that in this figure, the inside and outside corners of bottom 13*e* are slightly rounded to aid in mold release if required.

The molded retaining housing 13 would be made of PVC, but the material would not be limited to PVC.

The retaining housing would have an inside diameter 13*a* slightly larger than the outside diameter of the casing of the pop-up head to allow free turning of the pop-up head.

The wall thickness 13*b* of retaining housing would be the same as that of the retaining housing of FIG. 1 and FIG. 2, to allow standardization of the retaining housing adapters.

The height 13*c* of the retaining housing would be about 40% longer than the pop-up head to allow for the connecting pipe nipple.

The retaining housing 13 would have a hole 13*d* with a diameter slightly larger than the outside diameter of the threaded riser of the conventional tee and 90° elbow in the bottom 13*e*.

The retaining housing 13 would be placed over the threaded riser of the conventional tee or the 90° elbow and rest on the top of the tee or 90° elbow.

This space between the hole 13*d* and the tee or 90° elbow would allow movement of the retaining housing and the pop-up head and pipe nipple, in the event the head were hit by a lawn mower.

Any soil or sand that would enter through the narrow circumferential area between the hole 13*d* and the tee or the 90° elbow would not enter the underground water piping system, since the bottom of the retaining housing 13*e* would be below the opening in the threaded riser of the tee or the 90° elbow.

FIG. 9 is an adapter 14 cross sectioned through the center which would be used to raise the level of the retaining housing of FIG. 1, FIG. 2, FIG. 3, FIG. 4, FIG. 5, FIG. 6 and FIG. 8 if required.

Adapter 14 would be made of PVC today, but the material would not be limited to PVC.

The height that the adapter would add to the retaining housing is 14*a*.

The wall thickness 14*b* is the same as retaining housing 13, except that at 14*c* it is double that thickness.

The inside diameter 14*d* would be sufficient to give a slip-fit on the outside diameter of retaining housing 13, 11*a*, and 12*a*.

The inside diameter 14*e* would be the same as the inside diameter of retaining housing 13, and retaining housing 11*a* (FIG. 1, FIG. 4) and 12*a* (FIG. 2, FIG. 6.)

The adapters would be made in six lengths—¼", ½", ¾", 1", 2", and 3", using them separately or combining any two or three would provide any increased retaining housing length required.

FIG. 10 shows adapter 14 slip-fitted to retaining housing 13 cross sectioned through the center.

FIG. 11 is a perspective view, sectionalized through the center, of an adapter 15 to increase the height of the retaining housing for small diameter pop-up heads for versions four, five and six, if required, as shown in FIG. 13, FIG. 14, and FIG. 15.

The adapter for the retaining housing for medium size pop-up heads would, of course, be greater in diameter, and the adapter for large size pop-up heads would, of course, be even greater in diameter.

The adapter required for versions one, two, and three as shown in FIG. 9 and FIG. 10, it will be noted, while different in size has the same configuration as FIG. 11.

The adapter would be made of PVC today, but the material would not be limited to PVC.

Height 15*a* would be the length an adapter would add. This particular adapter would add ½" to the retaining housing height.

The wall thickness 15*b* would be the same as the wall thickness of the retaining housing 17*a*—FIG. 13, 19*a*—FIG. 14, and 24—FIG. 15, except for area 15*c* where it would double that thickness, as is "C" in FIG. 13, FIG. 14, and FIG. 15.

Diameter 15*d* would be sized to slip-fit over the top of the retaining housing.

Diameter 15*e* would be the same as the inside diameter of the retaining housing.

FIG. 12 is a perspective view of a retaining housing cap 16, cross sectioned through the center, for use with the retaining housing for small diameter pop-up heads for versions four, five, and six. As shown in FIG. 13, FIG. 14, and FIG. 15.

The cap for the retaining housing for medium size pop-up heads, of course, would be greater in diameter, and the cap for the retaining housing for large size pop-up heads would, of course, be even greater in diameter.

The height, however, would remain the same.

The retaining housing cap 16 would be made of PVC today, but the material would not be limited to PVC.

Diameter 16*a* would be that required to be slightly greater than the diameter of the casing of the pop-up head to allow free turning of the pop-up head.

The wall thickness 16*b* would be the same as the wall thickness of the retaining housing 17*a*—FIG. 13, 19*a*—FIG. 14, and 24—FIG. 15.

Diameter 16*c* would be sized to slip-fit over the top of the retaining housing or an adapter.

Height 16*d* would be that of one half the width of the wide rubber band, which would be placed around it and the casing.

FIG. 13, FIG. 14, and FIG. 15 as previously mentioned, only three diameters of retaining housings need be manufactured to cover all sizes of pop-up heads manufactured, and only three diameters of retaining housing adapters need be manufactured, and the adapters could be made in just six heights—¼", ½", ¾", 1", 2", and 3".

The retaining housing caps would be made in only three slip-fit diameters on the retaining housing end, and all would be of the same height.

The top of the cap into which the pop-up head is set would be made for each diameter of pop-up heads manufactured.

FIG. 13, FIG. 14, and FIG. 15 show the retaining housing for small diameter pop-up heads, various heights of adapters, and caps of three different diameter pop-up head casings.

The casings, covers, and pipe nipples shown form no part of the invention.

FIG. 13 is the front view of molded one piece combination retaining housing and tee 17, retaining housing adapter 15, and retaining housing cap 18, the invented parts. The figure also shows the cover 40*a* and casing 40*b* of 40, which is part of a pop-up head, pipe nipple 50, and wide rubber band 30, for illustrative purposes.

All parts are sectionalized through the center, except cover 40*a* and pipe nipple 50.

Parts 17, 15 and 18 would be made of PVC today, but the material would not be limited to PVC.

The diameter 17*d* would be the diameter set by the manufacturer or the industry for small diameter pop-up heads. (This diameter is the same in FIG. 14 and FIG. 15.)

The wall 17*b* would have the same thickness as the wall of the slip-fit area 17*g* of tee portion 17*f*, or less. (Same dimension as FIG. 14 and FIG. 15.)

The height 17*c* of retaining housing 17*a* would be about 40% longer than the pop-up head to allow for the pipe nipple. (Same dimension as FIG. 14 and FIG. 15.)

Bottom 17*e* of the retaining housing 17*a* forms an integral wall with the top of the wall of slip-fit areas 17*g* and 17*h*. (Same dimension as FIG. 14.)

There could also be a space between the top of the wall of slip-fit areas 17*g* and 17*h*, and the bottom 17*e* of the retaining housing, the alternative shown in FIG. 1, FIG. 4, and FIG. 5.

Pipe nipple 50 places the top of cover 40*a* at ground level.

Adapter 15 is required to raise the height of the retaining housing 17*a* by ½".

It will be noticed that adapter 15 was shown in FIG. 11, and adapter 15 has the same configuration as adapter 14—FIG. 9.

15*a* is the height that the adapter will add to the retaining housing.

15*b* is the wall thickness which is the same as the wall thickness of the retaining housing 17*a*. (Same dimension as FIG. 14 and FIG. 15.)

The wall thickness at 15*c*, however, is double. (Same as FIG. 14 and FIG. 15.)

The diameter 15*d* slip-fits over the retaining housing 17*a*.

The inside diameter 15*e* is the same as the inside diameter 17*d* of retaining housing 17*a*. (Same as FIG. 14 and FIG. 15.)

Retaining housing cap 18 has a diameter 18*a* slightly larger than pop-up casing 40*b* to allow free turning of the casing.

The configuration of this cap 18 is the same as cap 16 of FIG. 12. However, it was assigned reference number 18, because the 18*a* diameter was different from the 16*a* diameter.

The thickness 18*b* of the cap is the same as the thickness of the retaining housing 17*a*. (Same dimension as FIG. 14 and FIG. 15.)

The diameter 18*c* slip-fits over adapter 15. (Same way as in FIG. 14 and FIG. 15.)

Height 18*d* is one half the width of a wide rubber band. (Same as FIG. 14 and FIG. 15.)

Wide rubber band 30 seals the slight circumferential area between 18*a* and casing 40*b*. (Same way as in FIG. 14 and FIG. 15.)

FIG. 14 is the front view of molded one piece combination retaining housing and 90° elbow 19, retaining housing adapters 21 and 22, and retaining housing cap 23, the invented parts. The figure also shows the cover 60*a* and casing 60*b* of 60, which is part of the pop-up head, pipe nipple 70, and wide rubber band 30, for illustrative purposes.

All parts are sectionalized through the center, except cover 60*a* and pipe nipple 70.

Parts 19, 21, 22 and 23 would be made of PVC today, but the material would not be limited to PVC.

The diameter 19*d* would be the diameter set by the manufacturer or the industry for small diameter pop-up heads. (This diameter is as same as in FIG. 13 and FIG. 15.)

The wall 19*b* would have the same thickness as the wall of slip-fit area 19*g* of 90° elbow portion 19*f*, or less. (Same dimension as FIG. 13 and FIG. 15.)

The height 19*c* of retaining housing 19*a* would be about 40% longer than the pop-up head to allow for the pipe nipple. (Same dimension as FIG. 13 and FIG. 15.)

Bottom 19*e* of the retaining housing 19*a* forms an integral wall with the top of the wall of the slip-fit area 19*g*. (Same dimension as FIG. 13.)

There could also be a space between the top of the wall of slip-fit area 19*g*, and the bottom 19*e* of the retaining housing, the alternative shown in FIG. 2 and FIG. 6.

Pipe nipple 70 places the top of cover 60*a* at ground level.

Two adapters 21 and 22 raise the height of the retaining housing to the required level. Adapter 21 as shown by 21*a* adds 1", and adapter 22 as shown by 22*a* adds ¾". (Again, the configuration of these adapters is the same as adapters 15—FIG. 11, and adapter 14—FIG. 9.)

Different reference numbers were assigned to better show the use of different lengths of adapters.

21*b* and 22*b* are the wall thickness of the adapters which is the thickness of the retaining housing 19*a*. (Same dimension as FIG. 13 and FIG. 15.)

The wall thickness of 21*c* and 22*c*, however, is double. (Same as FIG. 13 and FIG. 15.)

The diameter 21*d* slip-fits over the retaining housing 19*a*, and diameter 22*d* slip-fits over adapter 21.

The inside diameters 21*e* and 22*e* are the same as the inside diameter of 19*a*. (Same as FIG. 13 and FIG. 15.)

Retaining housing cap 23 has a diameter 23*a* slightly larger than pop-up casing 60*b* to allow free turning of the casing.

The configuration of this cap 23 is the same as cap 16 of FIG. 12, however, it was assigned reference number 23, because the 23*a* diameter was different from the 16*a* diameter.

The wall thickness 23b of the cap is the same as the thickness of retaining housing 19a. (Same dimension as FIG. 13 and FIG. 15.)

The diameter 23c slip-fits over adapter 22. (Same way as in FIG. 13 and FIG. 15.)

Height 23d is one half the width of a wide rubber band. (Same as FIG. 13 and FIG. 15.)

Wide rubber band 30 seals the slight circumferential area between 23a and casing 60b. (Same way as in FIG. 13 and FIG. 15.)

FIG. 15 is the front view of molded retaining housing 24, retaining housing adapter 25 and retaining housing cap 16, the invented parts. The figure also shows the cover 10e, and casing 10n of 10, which is part of the pop-up head, the pipe nipple 80, and the wide rubber band 30. Also shown, is phantom tee 90. (The letter "a" was not used in the retaining housing reference numbers, allowing "b,c, d and e" to refer to the same areas as in FIG. 13 and FIG. 14.)

All parts are sectionalized through the center except cover 10e, and pipe nipple 80.

Parts 24, 25, and 16 would be made of PVC today, but the material would not be limited to PVC.

The diameter 24d would be the diameter set by the manufacturer or the industry for small diameter pop-up heads. (This diameter is the same for FIG. 13 FIG. 14.)

The wall 24b would have the same thickness as the wall 17b of FIG. 13, which is the same as wall 19b of FIG. 14.

The height 24c of retaining housing 24 would be about 40% longer than the pop-up head to allow for the pipe nipple. (Same dimension as FIG. 13 and FIG. 14.)

Hole 24f in bottom 24e is slightly larger than threaded upright 90a of phantom tee 90, the conventional tee used in lawn watering systems.

The retaining housing 24 would be placed over the threaded riser of the conventional tee. (Shown here in phantom form) and rest on the top of the tee.

This space between the hole 24f and the tee would allow movement of the retaining housing, the pop-up head, and the pipe nipple, in the event the head were hit by a lawn mower.

Any soil or sand that would enter through the narrow circumferential area between the hole 24f, and the tee would not enter the underground water piping system, since the bottom of the retaining housing 24e would be below the opening in the threaded riser of the tee.

The retaining housing could, of course, be used on a 90° elbow.

(The same pop-up casing 10n, and cover 10e as shown in FIG. 4 have been used in this figure.)

Pop-up nipple 80 places the top of cover 10e at ground level.

An adapter 25 raises the height of the retaining housing to the required level. Adapter 25 as shown by 25a adds 2". (Again, the configuration of the adapter is the same as adapter 15—FIG. 11, and adapter 14—FIG. 9.)

25b is the thickness of the adapter, which is the thickness of the retaining housing 24. (Same dimension as FIG. 13 and FIG. 14.)

The wall thickness at 25c, however, is double. (Same as FIG. 13 and FIG. 14.)

The diameter 25d slip-fits over the retaining housing 24a.

The inside diameter 25e is the same as the inside diameter 24d. (Same as FIG. 13 and FIG. 14.)

Retaining housing cap 16 (which is the same as shown in FIG. 12) has a diameter 16a slightly larger than pop-up casing 10n, to allow free tuning of the casing.)

The wall thickness 16b of the cap is the same as the thickness of the retaining housing 24. (Same dimension as FIG. 13 and FIG. 14.)

The diameter 16c slip-fits over adapter 25. (Same way as in FIG. 13 and FIG. 14.)

Height 16d is one half the width of a wide rubber band. (Same as FIG. 13 and FIG. 14.)

Wide rubber band 30 seals the slight circumferential area between 16a and casing 10n. (Same way as in FIG. 13 and FIG. 14.)

I claim:

1. An assembly for use in lawn watering systems for keeping soil, sand, small stones and debris from entering into the underground water piping system during removal of the casing of a pop-up head for repair or replacement of the pop-up head, said assembly consisting of a one piece molded article which includes an open topped retaining housing which encloses the casing of the pop-up head, and also includes a pipe fitting connectable to underground water pipes, said pipe fitting having a threaded riser and a horizontal portion with slip-fit openings for connection to the underground pipes, a pipe nipple connecting the pop-up head to the threaded riser of the pipe fitting of the one piece molded article, said pipe nipple being sized to set the top of the pop-up head at ground level, a molded flanged adapter fitted over the open top of the retaining housing of the one piece article to raise the height of the retaining housing required, said adapter having the same inside and outside diameters as the retaining housing except for its flange which is fitted over the top of the retaining housing, and a molded cap fitted over the top of the adapter, said cap having an axially aligned opening whose inside diameter is slightly larger than the diameter of the casing of the pop-up head, thereby leaving a slight circumferential open area between the cap and the casing of the pop-up head to allow free turning of the pop-up head during its installation and removal.

2. An assembly as set forth in claim 1 in which the pipe fitting is a tee as used in lawn watering systems.

3. An assembly as set forth in claim 1 in which the pipe fitting is a 90° elbow as used in lawn watering systems.

4. An assembly as set forth in claim 1 in which on the one piece article the bottom of the retaining housing and the top of the horizontal slip-fit portion of the fitting form an integral wall.

5. An assembly as set forth in claim 1 in which the verticle height of the threaded riser of the pipe fitting is about the same as the horizontal length of the slip-fit portion of the pipe fitting measured from the end of the slip-fit opening to the vertical center line of the threaded riser of the pipe fitting, and there is space between the bottom of the retaining housing and the top of the slip-fit portion of the fitting.

6. An assembly as set forth in claim 1 further including a plurality of molded adapters.

7. An assembly as set forth in claim 1 further including a wide rubber band placed around the top of the cap to seal the slight circumferential open area between the cap and the casing of the pop-up head.

8. An assembly for use in lawn watering systems for keeping soil, sand, small stones and debris from entering into the underground water piping system during removal of the casing of a pop-up head for repair or replacement of the pop-up head consisting of a one piece molded article which includes an open topped retaining housing which encloses the casing of the pop-up head, said retaining housing having an inside diameter slightly larger than the diameter of the casing of the pop-up head, thereby leaving a slight circumferential open area between the retaining housing and the casing of the pop-up head to allow free turning of the pop-up head during its installation and removal, said molded article also including a pipe fitting connectable to underground water pipes and having a threaded riser and a horizontal portion with slip-fit openings for connection to the underground water pipes, a pipe nipple connecting the pop-up head to the threaded riser of the pipe fitting of the one piece molded article, said pipe nipple being sized to set the top of the pop-up head at ground level, and a molded flanged adapter fitted over the open top of the retaining housing of the one piece article to raise the height of the retaining housing, said adapter having the same inside and outside diameters as the retaining housing except for its flange which is fitted over the top of the retaining housing.

9. An assembly as set forth in claim 8 in which the pipe fitting is a tee as used in lawn watering systems.

10. An assembly as set forth in claim 8 in which the pipe fitting is a 90° elbow as used in lawn watering systems.

11. An assembly as set forth in claim 8 in which the bottom of the retaining housing and the top of the horizontal slip-fit portion of the fitting form an integral wall.

12. An assembly as set forth in claim 8 in which the verticle height of the threaded riser of the pipe fitting is about the same as the horizontal length of the slip-fit portion of the pipe fitting measured from the end of the slip-fit opening to the verticle center line of the threaded riser of the pipe fitting, and there is space between the bottom of the retaining housing and the top of the slip-fit portion of the fitting.

13. An assembly as set forth in claim 8 further including plurality of molded adapters.

14. An assembly as set forth in claim 8 further including a wide rubber band placed around the top of the adapter to seal the slight circumferential open area between the adapter and the casing of the pop-up head.

15. An assembly for use in lawn watering systems, said lawn watering system including a pipe fitting for connecting a pop-up head to the underground water piping system which fitting includes a threaded riser connecting to a pipe nipple, for keeping soil, sand, small stones and debris from entering into the underground water piping system during removal of the casing of a pop-up head for repair or replacement of the pop-up head, said assembly consisting of a molded can shaped retaining housing having an open top and a flat bottom with an axial opening in its flat bottom sized to fit over the threaded riser of the pipe fitting of the underground water piping system, which housing encloses the casing of the pop-up head, the pipe nipple and the threaded riser of the fitting, said pipe nipple being sized to position the top of the pop-up head at ground level, a molded flanged adapter fitted over the open top of the retaining housing to raise the height of the retaining housing, said adapter having the same inside and outside diameters as the retaining housing except for its flange which is fitted over the top of the retaining housing, and a molded cap fitted over the top of the adapter, said cap having an axially aligned opening whose inside diameter is slightly larger than the diameter of the casing of the pop-up head, thereby leaving a slight circumferential open area between the cap and the casing of the pop-up head to allow free turning of the pop-up head for its installation and removal.

16. An assembly as set forth in claim 15 in which the pipe fitting is a tee as used in lawn watering systems.

17. An assembly as set forth in claim 15 in which the pipe fitting is a 90° elbow as used in lawn watering systems.

18. An assembly as set forth in claim 15 further including plurality of molded adapters.

19. An assembly as set forth in claim 15 further including a wide rubber band placed around the top of the cap to seal the slight circumferential open area between the cap and the casing of the pop-up head.

20. An assembly for use in lawn watering systems, said lawn watering system including a pipe fitting for connecting a pop-up head to the underground water piping system which fitting includes a threaded riser connecting to a pipe nipple, for keeping soil, sand, small stones and debris from entering into the underground water piping system during removal of the casing of a pop-up head for repair or replacement of the pop-up head, said assembly consisting of a molded can shaped retaining housing having an open top and a flat bottom, and having an inside diameter slightly larger than the casing of the pop-up head, thereby leaving a slight circumferential open area between the retaining housing and casing of the pop-up head to allow free turning of the pop-up head during its installation and removal, said housing also having an axial opening in its flat bottom sized to fit over the threaded riser of the fitting of the underground water piping system, which housing encloses the casing of the pop-up head, the pipe nipple and the threaded riser of the fitting, said pipe nipple being sized to position the pop-up head at ground level, and a molded flanged adapter fitted over the open top of the retaining housing to raise the height of the retaining housing, said adapter having the same inside and outside diameters as the retaining housing except for its flange which is fitted over the top of the retaining housing.

21. An assembly as set forth in claim 20 in which the pipe fitting is a tee as used in lawn watering systems.

22. An assembly as set forth in claim 20 in which the pipe fitting is a 90° elbow as used in lawn watering systems.

23. An assembly as set forth in claim 20 further including plurality of molded adapters.

24. An assembly as set forth in claim 20 further including a wide rubber band placed around the top of the adapter to seal the slight circumferential open area between the adapter and the casing of the pop-up head.

* * * * *